United States Patent [19]

Boussemart et al.

[11] Patent Number: 4,629,210

[45] Date of Patent: Dec. 16, 1986

[54] SAFETY BINDING

[75] Inventors: Jean-Pierre Boussemart, Choisy; Dominique Vuarier, Annecy-le-Vieux, both of France

[73] Assignee: Salomon S.A., Annecy, France

[21] Appl. No.: 610,426

[22] Filed: May 15, 1984

[30] Foreign Application Priority Data

May 16, 1983 [FR] France ..... 83 08068

[51] Int. Cl.[4] ..... A63C 9/22

[52] U.S. Cl. ..... 280/634

[58] Field of Search ..... 280/625, 630, 633, 634, 280/635, 11.32, 11.34; 403/57, 62

[56] References Cited

U.S. PATENT DOCUMENTS 2,102,669 12/1937 Barieau ..... 280/635
2,199,937 5/1940 Keller ..... 280/635

FOREIGN PATENT DOCUMENTS 2720646 11/1978 Fed. Rep. of Germany .
1336704 12/1963 France .
1480207 5/1967 France .
2150561 4/1973 France .
2354180 10/1977 France .

*Primary Examiner*—John J. Love
*Assistant Examiner*—Richard Camby
*Attorney, Agent, or Firm*—Sandler & Greenblum

[57] ABSTRACT

A safety binding for a ski including a body and a jaw having two lateral retention wings adapted to hold the boot and which are journalled on the body. Also included are two rotatable adjustment screws each adapted to adjust the position of one of the lateral retention wings, to accommodate boots of different widths. A coupling apparatus is also provided for coupling the rotation of the adjustment screws. As a result, when the skier adjusts the position of one of the wings by rotating one of the screws, the position of the other wing is automatically adjusted. In order to accommodate the journalling of the wings on the body, the coupling apparatus permits the orientation of the longitudinal axes of the screws to be changed with respect to each other, as the wings journal on the body in response to rotation of the screws.

52 Claims, 8 Drawing Figures

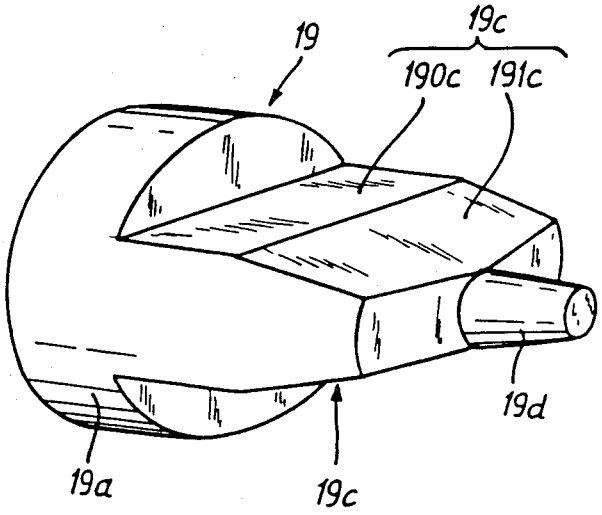
FIG. 7.
FIG. 8.
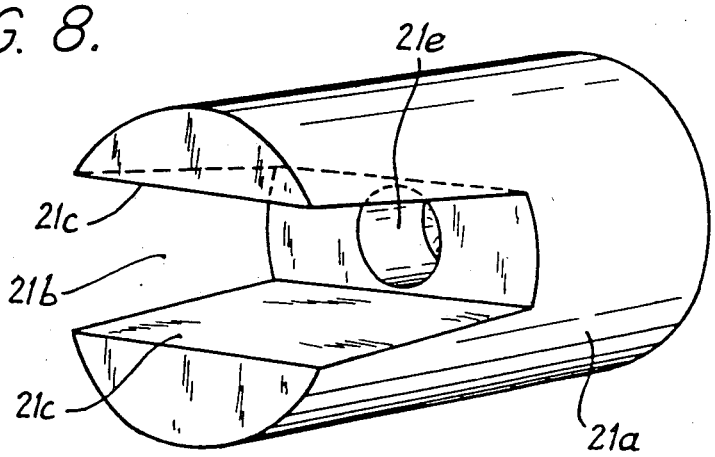

SAFETY BINDING

BACKGROUND OF THE INVENTION

1. Field of the Invention

The present invention relates to a safety ski binding having lateral retention wings and adjustment screws for adjusting the position of the wings to accommodate boots of different widths.

2. Description of the Prior Art

Safety ski bindings known as "front abutment" bindings, immobilize of the front portion of a ski boot. This type of front abutment generally comprises a support element integral with the ski. The abutment also includes a unit comprising a body and a retention jaw. The retention jaw holds the boot, and the unit is adapted to laterally pivot, to the right or the left around the support element, against the bias of an elastic energization mechanism which defines the release threshold of the binding.

In order to adapt the retention jaw of such a front abutment to different shoe widths, the jaw is composed of two lateral retention wings, each journalled on the body around their respective pivoting axes. Adjustment elements such as screws are provided to independently adjust the position of each lateral retention wing. Such an arrangement is illustrated, for example, in French Pat. No. 1,336,704, the disclosure of which is hereby incorporated by reference. In the binding described therein, each wing comprises an adjustment screw located on either side of the binding. One adjusts the configuration and position of the jaw by manipulating the two screws using a screwdriver on either side of the binding to bring the two retention wings into contact with the boot. The necessity of using a screwdriver on both sides of the binding is both time consuming and awkward. To overcome this disadvantage, other binding constructions have been proposed.

For example, French Pat. No. 1,480,207 describes a front abutment having a body which pivots around a vertical axis integral with the ski. The body comprises two lateral retention wings whose angular positions with respect to the body are adjusted by means of a single screw which is screwed into the central portion of the body. Although this binding only requires one adjustment, such an adjustment apparatus has the disadvantage of having a complex and cumbersome structure. In addition, such a vertically disposed screw also has the disadvantage of being easily confused with the screw which adjusts the binding height and which is most often, itself, positioned vertically on the binding. The skier who is not knowledgeable can thus misadjust the width of the jaw of the binding while believing that he has adjusted the height, and vice versa.

SUMMARY OF THE INVENTION

The present invention overcomes the disadvantages of the prior art by providing a ski binding having journalled lateral retention wings and an apparatus for the adjustment of the wings which is of a particularly simple design and which allows for the simultaneous adjustment of the two wings in a single maneuver.

To achieve this objective, the binding of the present invention comprises a jaw adapted to maintain the boot. This jaw comprises two lateral retention wings journalled on a body around respective axes, and two adjustment screws for adjusting the position of the lateral retention wings. The two screws are adapted to be disposed in a substantially transverse direction, respectively, in the two wings. The adjustment screws each include a head which is accessible from the exterior so that they can be rotated by means of a tool such as a screwdriver. The internal end of each screw is immobilized against translational movement on a central portion of the body. The openings in the binding in which the screws are engaged are threaded so as to receive the correspondingly threaded portions of the two adjustment screws. The internal ends of these screws are connected to one another by a coupling apparatus which couples the rotation of these screws, while allowing for an angular movement or pivoting of the axes of the screw.

This ski binding of the present invention has the advantage that to adjust the spacing of the lateral retention wings, it suffices to rotate only one of the adjustment screws so that it is displaced into one of the wings. This rotational movement of this screw is transmitted by the coupling apparatus to the other screw, such that the two adjustment screws rotate at the same time and concomitantly pivot the two lateral retention wings around their respective axes. The adjustment of the spacing of the wings, so that they can be adapted to boots of different widths, is thus considerably simplified.

According to one embodiment, the invention comprises a safety ski binding for holding a boot on a ski. The binding comprises a jaw which includes first and second displaceable elements, each adapted to hold at least a portion of the boot. The binding also includes first and second adjustment means for adjusting the displacement of the first and second jaw elements, respectively. Also, a coupling means is provided for coupling the first and second adjustment means so that adjustment of the displacement of one of the jaw elements also adjusts the displacement of the other of the jaw elements.

These jaw elements are adapted to be displaced in a direction transverse to the longitudinal axis of the binding. In this embodiment, the first and second adjustment means each comprise adjustment screws adapted to rotate about an axis transverse to the binding in one of the jaw elements. In addition, each adjustment screw comprises means for adjusting the transverse position of one of the elements, in response to rotation of the adjustment screw. The coupling means couples the rotation of one of the screws with the rotation of the other of the screws. In one embodiment, the coupling means may comprise a universal joint, and the coupling means may be adapted to permit pivoting of the adjustment screws with respect to a horizontal longitudinal axis and with respect to a vertical axis. In addition, the horizontal longitudinal axis and this vertical axis may intersect at a point intersected by the longitudinal plane of symmetry of the binding and the longitudinal axis of the screws.

In one embodiment, the jaw elements comprise lateral retention wings journalled around a substantially vertical axis. In addition, the binding may further include a body attached to the ski, on which the lateral retention wings are journalled. In this embodiment, each adjustment screw comprises means for journalling one of the wings on the body.

The binding may also include elastic means for biasing each of the wings toward the interior of the body. In one embodiment, these elastic means comprise two elastically deformable extensions, each integral with one of the wings. The extensions are so positioned that they abut the body, regardless of the position of the wings.

At least one of the screws comprises an outer head, accessible from the exterior of the binding, which is adapted to engage a tool, such as a screwdriver, for rotating the head. In another embodiment, both screws comprise such an outer head.

The body comprises a central portion adapted to receive an internal portion of the screw. This internal portion of the screw is immobilized against translational movement in the central portion of the body, as will be described herein below.

Each adjustment screw comprises a threaded portion having threads thereon such that the threads on one screw are oriented in the opposite direction from the threads on the other screw. In addition, each wing further comprises two openings, adapted to receive one of the screws. Each opening comprises internal threads adapted to mate with the threads on one of the screws. In one embodiment, the longitudinal axes of the openings are horizontal. In another embodiment, the longitudinal axes of the openings in the wings are inclined with respect to a horizontal axis from the bottom to the top of the wing and from the exterior to the interior of the wing.

The coupling means comprises a male element integral with one of the screws, and a female element integral with the other of the screws. In addition, the body further comprises two notches opening toward the rear of the binding, and a stirrup disposed in the notches. The stirrup opens toward the rear of the binding and comprises two lateral arms each having a notch therein. Each screw further comprises a shaft having a smaller diameter than the its threaded portion. This shaft connects the threaded portion of the screw to one of the male and female elements. Each shaft extends through one of the notches in the body and extends through one of the notches in the lateral arms of the stirrup. The notches and the body together comprise a substantially U-shaped central opening, open toward the rear of the binding. In addition, the stirrup is also substantially U-shaped, and further comprises a core, positioned in the anterior portion of the central space such that the lateral arms are attached to either end of this core. The lateral arms extend toward the rear of the binding, and the coupling means is housed in this central space.

The male and female elements further comprise an expanded head having a diameter greater than the width of the notches in the body and the stirrup. The male element further comprises a flattened portion, integral with the expanded head and having a width substantially greater than its height. The flattened portion includes two flat surfaces on opposite sides of the flattened portion and parallel to the longitudinal axis of the male element. The expanded head of the female element comprises a transverse opening, open in the direction of the male element. The transverse opening is defined by two spaced apart planar surfaces on opposite sides of the female element and on the internal surface of the transverse opening. The two flat surfaces of the male element are adapted to engage the two planar surfaces of the female element, respectively. The transverse opening has a width substantially greater than its height, and the internal surfaces of the opening are flared outwardly toward the exterior of the female element.

The flattened portion of the male element further comprises two converging surfaces each integral with one of the flat surfaces, and extending from the flat surfaces toward the female element. Each converging surface converges toward the longitudinal axis of the male element.

The male element further comprises a conical projection extending from the converging sections toward the female element. In addition, the female element further comprises an opening in the expanded head and at one end of the transverse opening, adapted to receive this conical projection therein.

The screws are adapted to be displaced between a first and a second position in response to rotation of the screws. In the first position, the longitudinal axes of the screws are positioned in a single transverse plane. In the second position, the longitudinal axes of the screws form an obtuse angle open toward the front of the binding. The longitudinal axes of the screws are inclined symmetrically with respect to the longitudinal and vertical plane of symmetry of the binding.

According to another embodiment of the invention, the invention comprises an adjustment apparatus for a ski binding having first and second jaw elements adapted to hold a ski boot on a ski. These jaw elements are adapted to be displaced. The apparatus comprises first and second adjustment means for adjusting the displacement of the first and second jaw elements, respectively. The apparatus also includes a coupling means for coupling the first and second adjustment means so that adjustment of the displacement of one of the jaw elements adjusts the displacement of the other of the jaw elements.

The first jaw element comprises a first lateral retention wing, and the second jaw element comprises a second lateral retention wing. These first and second lateral retention wings are adapted to be displaced in a direction transverse to the longitudinal axis of the ski, and the first and second adjustment means adjust the transverse position of the wings.

Each wing is journalled on a body attached to the ski, around a substantially vertical axis. In addition, the first and second adjustment means each comprises adjustment screws adapted to be rotated around an axis transverse to the longitudinal axis of the ski in one of the wings. Each screw comprises means for journalling the wing on the body and the coupling means comprises means for coupling the rotation of one of the screws with the rotation of other of the screws. The coupling means is also adapted to permit pivoting of the screws with respect to a horizontal longitudinal axis of the binding and a vertical axis. In one embodiment, the coupling means may comprise a universal joint.

At least one of the screws comprises an outer head, accessible from the exterior of the binding, and adapted to engage a tool for rotating the head. In another embodiment, both screws comprise such an outer head.

In addition, the body comprises two notches therein. Each screw comprises a threaded portion having an exterior end to which the head is attached, and an interior end. Each wing comprises an opening adapted to receive one of the screws and comprising an internally threaded portion. The internally threaded portion of each screw is adapted to mate with the internally threaded portion of the wing. The threaded portions of the first screw and the first wing have opposite orientation from the threaded portions of the second screw and the second wing. In addition, the coupling means comprises two elements, each integral with the interior end of one of the threaded portions of the screws. Each element of the coupling means comprises an expanded head abutting the notch in the body, and having a diameter greater than the width of the notch. In one embodiment, one of the elements of the coupling means comprises a male element and the other of the elements of the coupling means comprises a female element.

In addition, the body comprises a stirrup having two lateral arms, and each having a notch therein. Each screw further comprises a shaft having a smaller diameter than the threaded portion, and connecting the threaded portion to the expanded head. Each expanded head abuts a notch in the stirrup, and each shaft extends through one notch in the stirrup and in the body.

The male element further comprises a flattened portion integral with the expanded head, and having a width substantially greater than its height. The flattened portion includes two flat surfaces on opposite sides of the flattened portion and parallel to the longitudinal axis of the male element. The expanded head of the female element further comprises a transverse opening, open in the direction of the male element. The transverse opening is defined by two spaced apart planar surfaces on opposite sides of the female element and on the internal surfaces of the transverse opening. The two flat surfaces of the male element are adapted to engage the two planar surfaces of the female element, respectively. The internal surfaces of the openings are flared outwardly toward the exterior of the female element.

In addition, the flattened portion further comprises two converging surfaces, each integral with one of the flat surfaces, and extending from the flat surfaces toward the female element. These converging surfaces converge toward the longitudinal axis of the male element.

The male element further comprises a conical projection extending from the converging sections toward the female element. The female element further comprises an opening in the expanded head and at one end of the the transverse opening, adapted to receive the conical projection therein.

BRIEF DESCRIPTION OF THE DRAWINGS

The invention will now be described by way of non-limiting example with reference to the attached drawings in which:

FIGS. 7 and 8 are perspective views, respectively, illustrating the male and female elements of the coupling apparatus.

DESCRIPTION OF PREFERRED EMBODIMENTS

Figure 1:
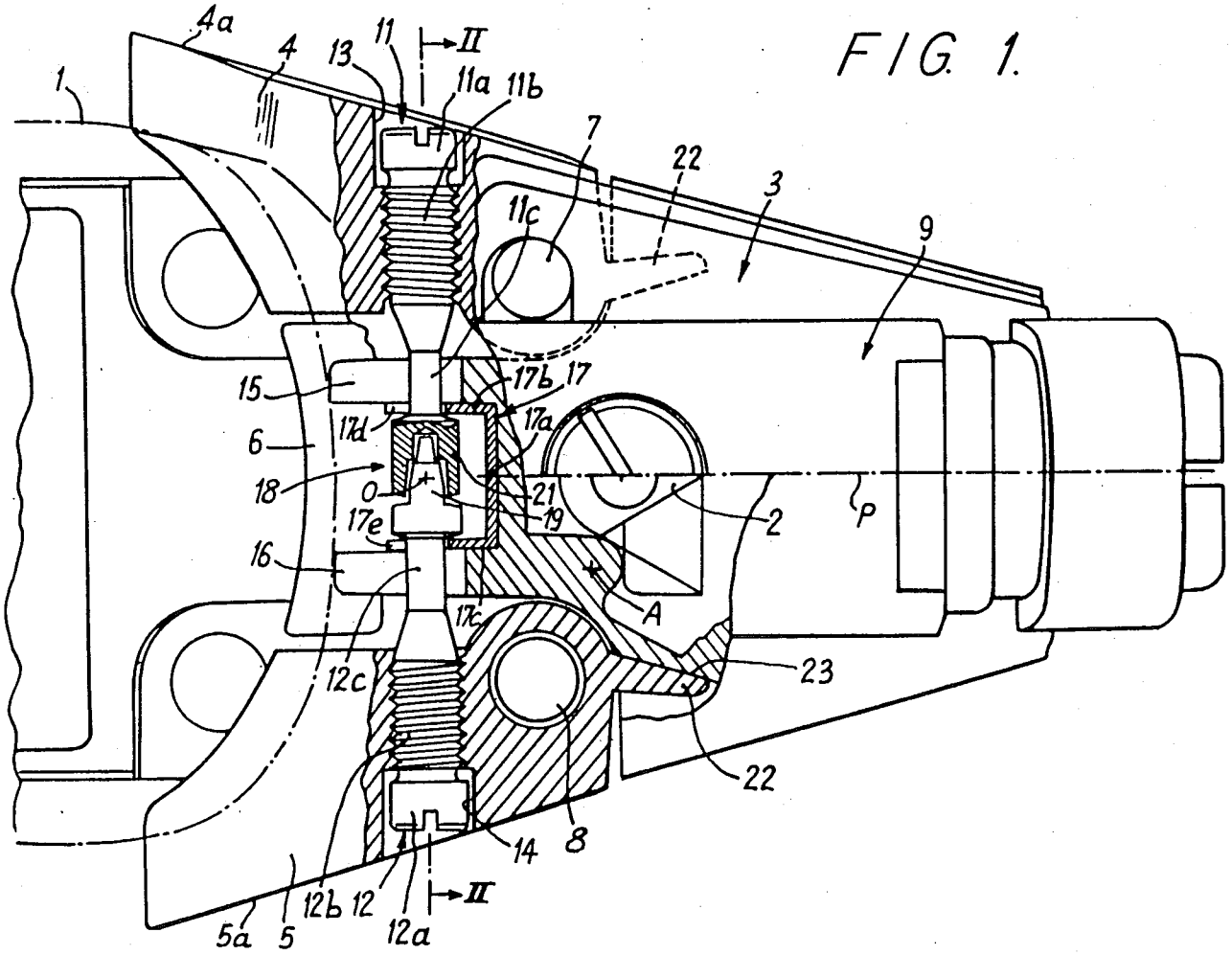
FIG. 1 is a planar view, partially broken away, of a safety ski binding of the present invention, the lateral retention wings being shown in the contracted, tightened position corresponding to a minimum shoe width.
Figure 3:
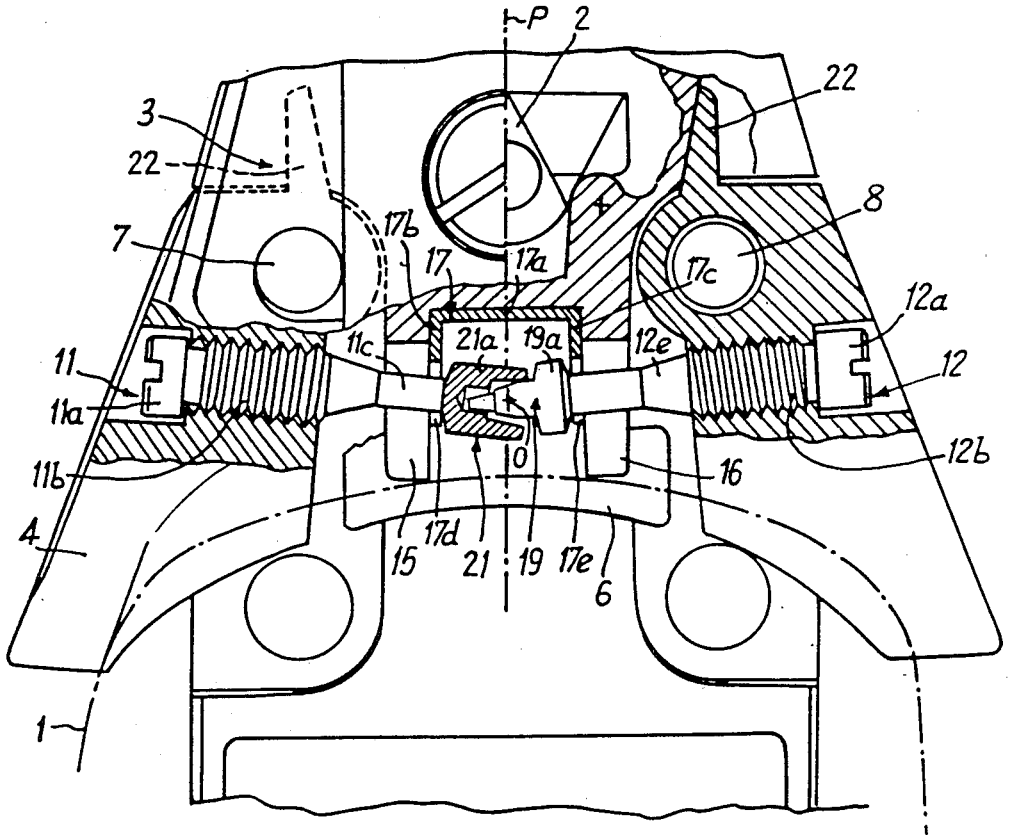
FIG. 3 is a partial planar view of the binding, the lateral retention wings being shown in a spaced apart position corresponding to a shoe having a width larger than the width of the shoe held by the binding in FIG. 1.
Figure 4:
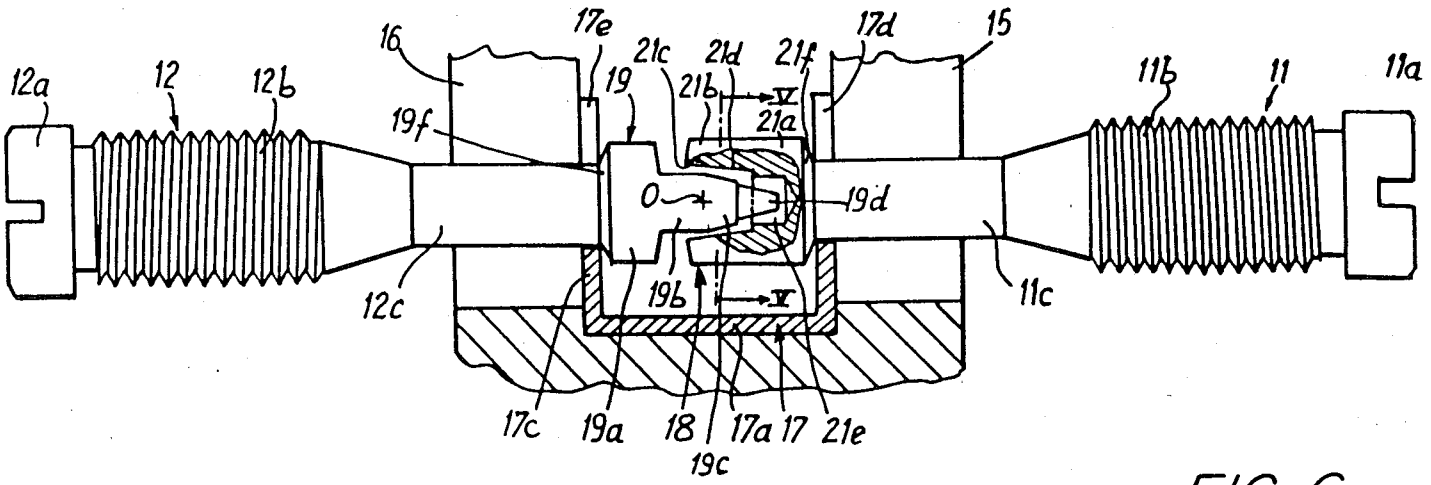
FIG. 4 is a planar view, partially in horizontal cross-section, of an embodiment of an apparatus for coupling the two adjustment screws, in a coaxial position.

The safety binding shown in FIGS. 1 and 3 is adapted to maintain the end of a ski boot 1 shown in dashed lines. This safety binding comprises, in a known manner, an assembly pivotably mounted on a support element 2 attached to the ski. This assembly comprises a body 3 at the front end thereof. The rear end of the assembly comprises two lateral retention wings 4 and 5 forming, with a central support 6, a maintenance jaw for maintaining the front of the boot. Central support 6 forms a single element with body 3. The two lateral retention wings 4 and 5 are journalled on the body around respective substantially vertical axes 7 and 8. Body 3 is pivotably mounted on support element 2, in a known manner, around two parallel or converging lateral support lines, of which one, i.e., the right support line A, appears in FIG. 1. Body 3 is biased under pressure against support element 2 by an elastic energization mechanism which is not shown in detail and which is indicated in its entirety by reference numeral 9 in FIG. 1.

In FIG. 1, wings 4 and 5 are shown in their contracted or tightened position, corresponding to the maintenance of a boot 1 of small width, while in FIG. 3, wings 4 and 5 are spaced further apart towards the exterior, to maintain a boot 1 of greater width.

Two adjustment screws 11 and 12 are used to adjust the position of the two lateral retention wings 4 and 5, respectively. More specifically, screws 11 and 12 are adapted to displace wings 4 and 5 in a direction transverse to the longitudinal axis of the binding, to accommodate boots of different widths. This is accomplished by journalling wings 4 and 5 around axes 7 and 8, respectively, as will be discussed below.

Figure 2:
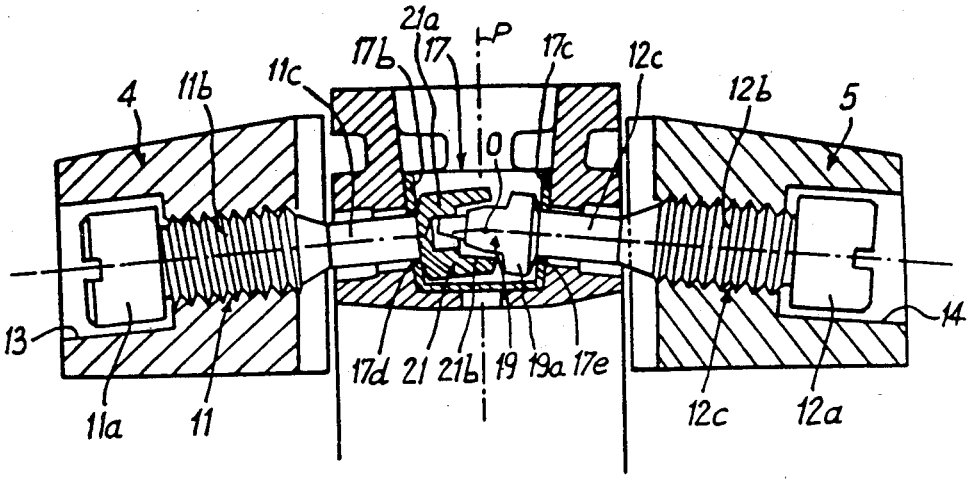
FIG. 2 is a vertical and transverse cross-sectional view along line II—II of FIG. 1.

Screws 11 and 12 are positioned symmetrically with respect to the longitudinal plane of symmetry P of the binding. In addition, screws 11 and 12 engage housings or openings 13 and 14, respectively, which extend substantially transversely in each wing 4 and 5. The longitudinal axes of these openings are either horizontal or slightly inclined with respect to a horizontal axis, from bottom to top of the binding and from the exterior of the binding towards the longitudinal plane of symmetry P as is shown in FIG. 2. Openings 13 and 14 communicate with the vertical external surfaces 4*a* and 5*a* of wings 4 and 5 by means of recesses. Screws 11 and 12 comprise, respectively, outer heads 11*a* and 12*a* which are adapted to be positioned in these recesses. These heads are, therefore, accessible from the exterior and are adapted to be rotatably manipulated by means of a tool such as a screwdriver. It is within the scope of the invention to provide only one screw with a head. Thus, in this alternative embodiment, screw 11 may have head 11*a*, but screw 12 will not include an outer head. Such an embodiment is seen in FIG. 9. Alternately, screw 12 may include head 12*a*, but screw 11 may not have head 11*a*.

Screws 11 and 12 further comprise threaded portions 11*b* and 12*b*, respectively, which are integral with heads 11*a* and 12*a*, respectively. Threaded portions 11*b* and 12*b* have identical threads but are oriented in the opposite direction. These threaded portions 11*b* and 12*b* are screwed into internal threads of corresponding threadings provided in the wall of openings 13 and 14.

Screws 11 and 12 also include shafts 11*c* and 12*c*, respectively, which are integral with threaded portions 11*b* and 12*b*, respectively. Shafts 11*c* and 12*c* extend away from threaded portions 11*b* and 12*b*, in the direction of the longitudinal plane of symmetry P of the binding and the ski. Shafts 11*c* and 12*c* are substantially cylindrical and have a smaller diameter than threaded portions 11*b* and 12*b*, respectively. In addition, shafts 11*c* and 12*c* extend towards one another and traverse notches 15 and 16 provided in the rear portion of body 3 and opening substantially horizontally towards the rear. Notches 15 and 16 define a central space in body 3 having a substantially U-shaped configuration which opens rearwardly and which is adapted to receive a stirrup 17 which is lodged therein. Stirrup 17 comprises a core 17*a* positioned in the anterior end of the central space, and two lateral arms 17*b* and 17*c* extending towards the rear. Lateral arms 17*b* and 17*c* both comprise, respectively, notches 17*d* and 17*e*. These notches 17*d* and 17*e* of stirrup 17 are superimposed, as seen in the transverse direction, on notches 15 and 16 of body 3. Shafts 11*c* and 12*c* also extend through notches 17*d* and 17*e*, respectively.

According to the invention, screws 11 and 12 are coupled to one another by means of a coupling apparatus 18 which links the internal ends of the adjustment screws 11 and 12. Coupling apparatus 18, as seen in FIGS. 1–6, is housed in the central space defined between lateral arms 17*b* and 17*c* of stirrup 17. This coupling apparatus 18 comprises any universal journal apparatus or joint which is known in the art. Coupling apparatus 18 couples screws 11 and 12 so that adjustment of the displacement of one of the wings adjusts the displacement of the other wing. More specifically, coupling apparatus 18 is adapted to transmit the rotation of one of the adjustment screws 11 and 12 to the other screw, and is also adapted to permit an angular movement or pivoting of screws 11 and 12 with respect to two concurrent axes, i.e., a horizontal, longitudinal axis of said binding and ski, and a vertical axis, such that these two axes intersect at the center of the journal point O. Journal point O is defined by the intersection of the longitudinal plane of symmetry P of the binding and ski, and the longitudinal axes of screws 11 and 12.

Coupling apparatus 18, illustrated by way of example in FIGS. 1–8, comprises two elements which are nested within one another, i.e., a male element 19 integral with screw 12 and a female element 21 integral with screw 11. Each of the male and female elements, 19 and 21 comprise respectively, an expanded head 19*a* and 21*a*. Head 19*a* has a diameter greater than the width of the notches 16 and 17*e*, and head 21*a* has a diameter greater than the width of notches 15 and 17*e*. As a result, elements 19 and 21 of coupling apparatus 18 are retained within stirrup 17, as can be seen in FIGS. 1 and 2, and they cannot, as is the case for screws 11 and 12, be displaced to the exterior of the binding. Furthermore, because expanded heads 19*a* and 21*a* abut notches 17*e* and 17*d*, respectively, when screws 11 and 12 are rotated, they cannot be displaced to any substantial extent in the transverse direction. As a result, when screws 11 and 12 are rotated, wings 4 and 5 will pivot around axes 7 and 8, respectively. Heads 19*a* and 21*a* of elements 19 and 21 are, respectively, connected to shafts 11*c* and 12*c* by truncated cone-shaped projections 19*f* and 21*f* supported against lateral arms 17*b* and 17*c* of stirrup 17.

Cylindrical head 19*a* of the male element includes a flattened portion 19*b* integral with head 19*a* and which extends from head 19 toward the female element. Flattened portion 19 has a width that is substantially greater than its height and which is substantially greater than the height of opening 21*b* in female member 21. As a result, when male member 19 is rotated in opening 21*b*, female member 21 also rotates. Flattened portion 19*b* is defined by and comprises two surfaces 19*c* which extend in the substantially longitudinal direction of the male member and are disposed on diametrically opposite sides of head 19*a* from one another. Each surface 19*c* comprises two portions, i.e., a first portion and surface 190*c* substantially parallel to the longitudinal axis of head 19 and a second portion and surface 191*c* which extends from first portion 190*c* toward the female element and which converges towards the longitudinal axis of head 19. Flattened portion 19*b* also includes a central conical projection 19*d* integral with head 19 and which extends from portion 19*b* toward the female element.

Figure 5:
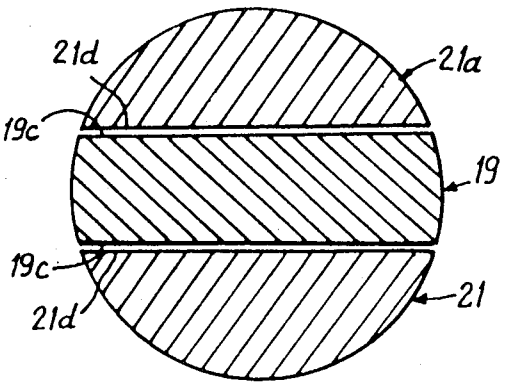
FIG. 5 is a cross-sectional view, on an enlarged scale, along line V—V of FIG. 4.

Head 21*a* of the female element comprises a transverse opening 21*b* which opens in the direction of male element 19 and which is adapted to receive male element 19 therein. The transverse opening is defined by two opposite planar surfaces 21*c* which extend towards one another and which are flared outward towards the exterior. In addition, an opening 21*e* is provided along the longitudinal axis of head 21*a*, in the end of transverse opening 21*b*. Opening 21*e* is adapted to receive the extreme conical projection 19*d* of male element 19. In addition, flattened portion 19*b* of male element 19 is adapted to engage transverse opening 21*b* of female element 21 and surfaces 190*c* and 191*c* are adapted to engage and be disposed between planar surfaces 21*c*. The coupling of screws 11 and 12 occurs because the cooperation between projecting flattened portion 19*b* and surfaces 21*c* of opening 21*b*. As can be seen in FIG. 5, the distance between the two opposed planar surfaces 21*d* of female member 21 is slightly greater than the thickness of the male element 19 between the two opposed flattened portions 19*c*.

It is evident from the description which has preceded that when one of the adjustment screws, for example screw 11, is rotated to adjust the spacing of lateral retention wings 4 and 5, the rotation of screw 11 is transmitted, by means of coupling apparatus 18, to adjustment screw 12, and vice versa. As a result, it is evident that coupling apparatus 18 is a universal journal.

Furthermore, coupling apparatus 18 permits screws 11 and 12 to move from their position illustrated in FIG. 1, in which their respective longitudinal axes are positioned in a single transverse plane (a position corresponding to the minimal shoe width) to the position illustrated in FIG. 3 in which the longitudinal axes of screws 11 and 12 form, in a plane, an obtuse angle which is open towards the front (a position corresponding to the maximum width of the boot). It should also be noted that in a vertical and transverse plane, as seen in FIG. 2, the longitudinal axes of the two screws can also be symmetrically inclined with respect to the vertical and longitudinal plane of symmetry P of the binding and the ski.

Figure 6:
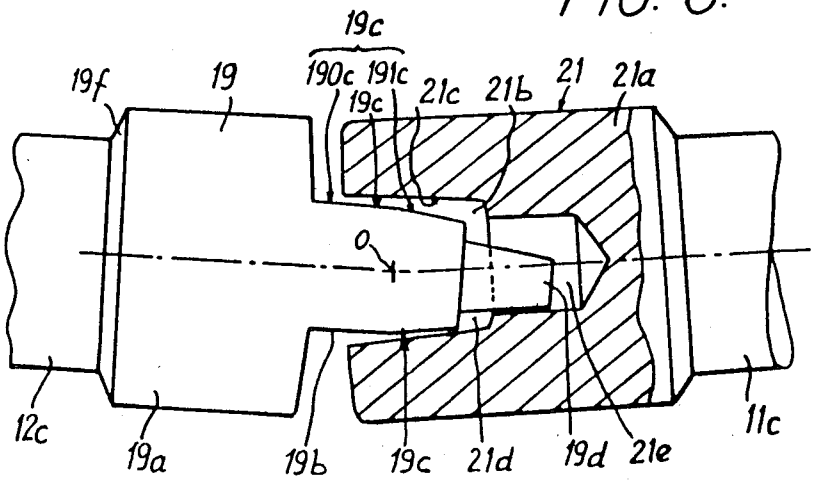
FIG. 6 is a longitudinal cross-sectional view, on a magnified scale, of the apparatus for the coupling of the two adjustment screws, wherein the axes of these two screws form an angle therebetween.

The outwardly flared portion 21*c* of head 21*a* of female element 21 is adapted to permit a certain angular movement or pivoting between the longitudinal axes of screws 11 and 12 to prevent the locking of the coupling apparatus, as can be seen in FIG. 6. In addition, conical portion 19*d* engages opening 21*e* to assure linkage between the two screws during the assembly of the jaw. By virtue of this projection 19*d* there can be no sliding or uncoupling in the plane of the flattened portion 19*b*.

To prevent floating of wings 4 and 5, these wings are preferably provided with means for permanently elastically biasing them towards the interior of the binding. These elastic biasing means can comprise extensions 22 which are attached to or are integral with each wind and extend towards the front. Extensions 22 permanently abut a fixed abutment 23 of body 3, regardless of the position of wings 4 and 5. Extensions 22 which are elastically deformable, act as return springs which bias, respective, wings 4 and 5 in the direction of the longitudinal plane of symmetry P of the binding and the ski. As a result, each wing 4 and 5 is maintained firmly against body 3, regardless of its angular position with respect to body 3. Extensions 22 also cause male element 19 and female element 21 of coupling apparatus 18 to be firmly engaged with each other, thereby avoiding the necessity of providing a transverse return spring housed in stirrup 17 to bias screws 11 and 12 towards the exterior.

As was previously noted, linkage apparatus 18 could comprise different means. For example, apparatus 18 could comprise, for example, a universal or cardan joint or could further comprise two conjugated male and female elements adapted to be nested to each other, which are different from those which have been illustrated in the drawings.

In addition, the adjustment apparatus according to the present invention can be utilized on a front abutment as well as on a heel clamp or any other apparatus of the boot binding type.

Additionally, although the invention has been described with respect to particular means, materials and embodiments, it is to be understood that the invention is not limited to the particulars disclosed and extends to all equivalents within the scope of the claims.

What is claimed is:

1. A safety ski binding for holding a boot on a ski, comprising:

(a) a jaw, comprising first and second elements, each adapted to be displaceably mounted on said ski and each adapted to hold at least a portion of said boot;

(b) first and second adjustment means, for adjusting the displacement of said first and second jaw elements, respectively, wherein the longitudinal axes of said first and second adjustment means pivot with respect to an element attached to said ski in response to adjusting the displacement of said first and second jaw elements, respectively; and (c) coupling means for coupling said first and second adjustment means wherein adjustment of the displacement of one of said jaw elements also adjusts the displacement of the other of said jaw elements, wherein said coupling means is adapted to permit pivoting of the longitudinal axes of said first and second adjustment means in response to displacement of said first and second jaw elements.

2. The binding defined by claim 1 wherein said elements are adapted to be displaced in a direction transverse to the longitudinal axis of said binding, wherein said first and second adjustment means each comprises adjustment screws adapted to rotate about an axis transverse to said binding in one of said elements, wherein each adjustment screw comprises means for adjusting said transverse position of one of said elements in response to rotation of said adjustment screw, and wherein said coupling means couples the rotation of one of said screws with the rotation of the other of said screws.

3. A safety ski binding for holding a boot on a ski, comprising:

(a) a jaw, comprising first and second elements adapted to be displaceably mounted on said ski, each element adapted to hold at least a portion of said boot;

(b) first and second adjustment means, for adjusting the displacement of said first and second jaw elements, respectively; and (c) coupling means for coupling said first and second adjustment means wherein adjustment of the displacement of one of said jaw elements also adjusts the displacement of the other of said jaw elements, wherein said elements are adapted to be displaced in a direction transverse to the longitudinal axis of said binding, wherein said first and second adjustment means each comprises adjustment screws adapted to rotate about an axis transverse to said binding in one of said elements, wherein each adjustment screw comprises means for adjusting said transverse position of one of said elements in response to rotation of said adjustment screw, and wherein said coupling means couples the rotation of one of said screws with the rotation of the other of said screws, wherein said coupling means is a universal joint.

4. The binding defined by claim 2 wherein said coupling means is adapted to permit pivoting of each of said adjustment screws with respect to a horizontal longitudinal axis and with respect to a vertical axis.

5. The binding defined by claim 4 wherein said horizontal longitudinal axis and said vertical axis intersect at a point defined by the intersection of the longitudinal plane of symmetry of said binding and the longitudinal axis of said screws.

6. The binding defined by claim 2, wherein said elements comprise lateral retention wings journalled around a substantially vertical axis.

7. The binding defined by claim 2 further comprising a body attached to said ski, on which said lateral retention wings are journalled, and wherein each of said wings is journalled on said body in response to rotation of one of said adjustment screws.

8. The binding defined by claim 7 further comprising elastic means for biasing each of said wings toward the interior of said body.

9. A safety ski binding for holding a boot on a ski, comprising:

(a) a jaw, comprising first and second displaceable elements, each adapted to hold at least a portion of said boot, wherein said elements are adapted to be displaced in a direction transverse to the longitudinal axis of said binding;

(b) first and second adjustment means, for adjusting the displacement of said first and second jaw elements, respectively, wherein said first and second adjustment means each comprise adjustment screws adapted to rotate about an axis transverse to said binding in one of said elements, wherein each adjustment screw comprises means for adjusting said transverse position of one of said elements in response to rotation of said adjustment screw;

(c) coupling means for coupling said first and second adjustment means wherein adjustment of the displacement of one of said jaw elements also adjusts the displacement of the other of said jaw elements, wherein said coupling means couples the rotation of one of said screws with the rotation of the other of said screws;

(d) a body attached to said ski, on which said lateral retention wings are journalled, wherein each of said wings is journalled on said body in response to rotation of one of said adjustment screws; and (e) elastic means for biasing each of said wings toward the interior of said said body, wherein said elastic means comprises two elastically deformable extensions, each integral with one of said wings, wherein said extensions abut said body, regardless of the position of said wings.

10. The binding defined by claim 7 wherein only one of said screws comprises an outer head, accessible from the exterior of said binding, and adapted to engage a tool for rotating said head.

11. The binding defined by claim 7 wherein at least one of said screws comprises an outer head, accessible from the exterior of said binding, and adapted to engage a tool for rotating said head.

12. The binding defined by claim 11 wherein both screws comprise an outer head, accessible from the exterior of said binding and adapted to engage a tool for rotating said heads.

13. The binding defined by claim 12 wherein said body comprises a central portion and each screw further comprises an internal portion disposed in said central portion of said body, wherein said internal portions are immobilized against translational movement in said central portion of said body.

14. A safety ski binding for holding a boot on a ski, comprising:

(a) a jaw, comprising first and second displaceable elements, each adapted to hold at least a portion of said boot, wherein said elements are adapted to be displaced in a direction transverse to the longitudinal axis of said binding;

(b) first and second adjustment means, for adjusting the displacement of said first and second jaw elements, respectively, wherein said first and second adjustment means each comprise adjustment screws adapted to rotate about an axis transverse to said binding in one of said elements, wherein each adjustment screw comprises means for adjusting said transverse position of one of said elements in response to rotation of said adjustment screw, wherein at least one of said screws comprises an outer head, accessible from the exterior of said binding and adapted to engage a tool for rotating said head, wherein each screw comprises an internal portion;

(c) coupling means for coupling said first and second adjustment means wherein adjustment of the displacement of one of said jaw elements also adjusts the displacement of the other of said jaw elements, wherein said coupling means couples the rotation of one of said screws with the rotation of the other of said screws; and (d) a body attached to said ski, on which said jaw elements are journalled, wherein each of said elements is journalled on said body in response to rotation of one of said adjustment screws, wherein said body comprises a central portion, wherein said internal portion of each screw is disposed in said central portion of said body, wherein said internal portion of said screws are immobilized against translational movement in said central portion of said body, wherein said adjustments screws each comprise a threaded portion having threads thereon, wherein said threads on one screw are oriented in the opposite direction from the threads on the other screw, and wherein each wing further comprises two openings adapted to receive one of said screws, wherein each opening comprises internal threads adapted to mate with said threads on one of said screws.

15. The binding defined by claim 14 wherein the longitudinal axes of said openings in said wings are horizontal.

16. The binding defined by claim 14 wherein the longitudinal axes of said openings in said wings are inclined with respect to a horizontal axis from the bottom to the top of said wing and from the exterior to the interior of said wing.

17. The binding defined by claim 14 wherein said coupling means comprises:

(i) a male element integral with one of said screws; and (ii) a female element, integral with the other of said screws.

18. The binding defined by claim 17 wherein said body further comprises:

(i) two notches in said body, opening toward the rear of said binding;

(ii) a stirrup disposed in said notches, and opening toward the rear or said binding, comprising two lateral arms, each having a notch therein, and wherein each screw further comprises a shaft, having a smaller diameter than said threaded portion, wherein said shaft connects said threaded portion to one of said male and female elements, and wherein each shaft extends through one of said notches in said body and extends through one of said notches on said lateral arms of said stirrup.

19. The binding defined by claim 18 wherein said notches in said body together comprise a substantially U-shaped central space, open toward the rear of said binding, and wherein said stirrup is substantially U-shaped, further comprising a core positioned in the anterior portion of said space, wherein said two lateral arms are attached to either end of said core and extend toward the rear of said binding, and wherein said coupling means is housed in said central space.

20. The binding defined by claim 18 wherein each of said male and female elements further comprise an expanded head having a diameter greater than the width of said notches in said body and said stirrup.

21. The binding defined by claim 20 wherein said male element further comprises a flattened portion integral with said expanded head and having a width substantially greater than its height, and including two flat surfaces on opposite sides of said flattened portion and parallel to the longitudinal axis of said male element, and wherein said expanded head of said female element further comprises a transverse opening, open in the direction of said male element, wherein said transverse opening is defined by two spaced apart planar surfaces on opposite sides of said female element and on the internal surface of said transverse opening, wherein said two flat surfaces of said male element are adapted to engage said two planar surfaces of said female element, respectively.

22. The binding defined by claim 21 wherein said transverse opening has a width substantially greater than its height.

23. The binding defined by claim 22 wherein said internal surfaces of said opening are flared outwardly, toward the exterior of said female element.

24. The binding defined by claim 23 wherein said flattened portion further comprises two converging surfaces each integral with one of said flat surfaces and extending from said flat surface toward said female element, wherein each converging surfaces converge toward the longitudinal axis of said male member.

25. The binding defined by claim 24 wherein said male element further comprises a conical projection extending from said converging sections toward said female element, and wherein said female element further comprises an opening in said expanded head and at one end of said transverse opening, adapted to receive said conical projection therein.

26. The binding defined by claim 25 wherein said screws are adapted to be displaced between a first and a second position in response to rotation of said screws, wherein in said first position the longitudinal axes of said screws are positioned in a single transverse plane, and wherein in said second position the longitudinal axes of said screws form an obtuse angle open toward the front of said binding, and said longitudinal axes are inclined symmetrically with respect to the vertical and longitudinal plane of symmetry of said binding.

27. An adjustment apparatus for a ski binding having first and second jaw elements adapted to be displaced with respect to said ski and adapted to hold a boot on a ski, said apparatus comprising:

(a) first and second adjustment means for adjusting the displacement of said first and second jaw elements, respectively, wherein the longitudinal axes of said first and second adjustment means pivot with respect to an element attached to said ski in response to adjusting the displacement of said first and second jaw elements, respectively; and (b) coupling means for coupling said first and second adjustment means wherein adjustment of the displacement of one of said jaw element adjusts the displacement of the other of said jaw elements, wherein said coupling means is adapted to permit pivoting of the longitudinal axes of said first and second adjustment means in response to displacement of said first and second jaw elements.

28. The apparatus defined by claim 27 wherein said first jaw element comprises a first lateral retention wing and said second jaw element comprises a second lateral retention wing, wherein said first and second lateral retention wings are adapted to be displaced in a direction transverse to the longitudinal axis of said ski, wherein said first and second adjustment means adjust the transverse position of said wings.

29. The apparatus defined by claim 28 wherein each wing is journalled on a body attached to said ski, around a substantially vertical axis and said first and second adjustment means each comprise adjustment screws adapted to be rotated around an axis transverse to the longitudinal axis of said ski in one of said wings, wherein each wing is journalled on said body in response to rotation of one of said adjustment screws, and wherein said coupling means comprises means for coupling the rotation of one of said screws with the rotation of the other of said screws.

30. The apparatus defined by claim 28 wherein said coupling means is adapted to permit pivoting of said screws with respect to a horizontal longitudinal axis of said binding and a vertical axis.

31. An adjustment apparatus for a ski binding having first and second displaceable jaw elements adapted to be displaceably mounted on said ski and adapted to hold a boot on a ski, said apparatus comprising:

(a) first and second adjustment means for adjusting the displacement of said first and second jaw elements, respectively; and (b) coupling means for coupling said first and second adjustment means wherein adjustment of the displacement of one of said jaw element adjusts the displacement of the other of said jaw elements, wherein said coupling means comprises a universal joint.

32. The apparatus defined in claim 30 wherein only one of said screws comprises an outer head, accessible from the exterior of said binding, and adapted to engage a tool for rotating said head.

33. The apparatus defined in claim 31 wherein at least one of said screws comprises an outer head, accessible from the exterior of said binding and adapted to engage a tool for rotating said head.

34. The apparatus defined by claim 33 wherein both screws comprise said outer head.

35. The apparatus defined by claim 34 wherein said body comprises two notches therein and wherein each screw comprises a threaded portion having an exterior end to which said head is attached and an interior end, and wherein each wing comprises an opening adapted to receive one of said screws and comprising an internally threaded portion, wherein said threaded portion of each screw is adapted to mate with said internally threaded portion of said wing, and wherein said threaded portions of said first screw and said first wing have an opposite orientation from the threaded portions of said second screw and said second wing, and wherein said coupling means comprises two elements, each integral with said interior end of one of said threaded portions of one of said screws, wherein each element of said coupling means comprises an expanded head abutting said notch in said body and having a diameter greater than the width of said notch.

36. The apparatus defined by claim 35 wherein one of said elements of said coupling means comprises a male element and the other of said elements of said coupling means comprises a female element.

37. The apparatus defined by claim 36 wherein said body comprises a stirrup having two lateral arms, each having a notch therein, and wherein each screw further comprises a shaft having a smaller diameter than said threaded portion, and connecting said threaded portion to said expanded head, wherein each expanded head abuts a notch in said stirrup and wherein each shaft extends through one notch in said stirrup and in said body.

38. The apparatus defined by claim 37 wherein said male element further comprises a flattened portion integral with said expanded head and having a width substantially greater than its height, and including two flat surfaces on opposite sides of said flattened portion and parallel to the longitudinal axis of said male element, and wherein said expanded head of said female element further comprises a transverse opening, open in the direction of said male element, wherein said transverse opening is defined by two spaced apart planar surfaces on opposite sides of said female element and on the internal surface of said transverse opening, wherein said two flat surfaces of said male element are adapted to engage said two planar surfaces of said female element, respectively.

39. The apparatus defined by claim 38 wherein said internal surfaces of said opening are flared outwardly, toward the exterior of said female element.

40. The apparatus defined by claim 39 wherein said flattened portion further comprises two converging surfaces each integral with one of said flat surfaces and extending from said flat surface toward said female element, wherein said converging surfaces converge toward the longitudinal axis of said male member.

41. The apparatus defined by claim 40 wherein said male element further comprises a conical projection extending from said converging sections toward said female element, and wherein said female element further comprises an opening in said expanded head and at one end of said transverse opening, adapted to receive said conical projection therein.

42. The binding defined by claim 1 wherein the longitudinal axes of said first and second adjustment means are adapted to pivot with respect to a horizontal axis, wherein said coupling means is adapted to permit said pivoting with respect to said horizontal axis.

43. The binding defined by claim 1 wherein the longitudinal axes of said first and second adjustment means are adapted to be angularly displaced with respect to a vertical axis, wherein said coupling means is adapted to permit said angular displacement with respect to said vertical axis.

44. The apparatus defined by claim 27 wherein the longitudinal axes of said first and second adjustment means are adapted to pivot with respect to a horizontal axis, wherein said coupling means is adapted to permit said pivoting with respect to said horizontal axis.

45. The apparatus defined by claim 27 wherein the longitudinal axes of said first and second adjustment means are adapted to be angularly displaced with respect to a vertical axis, wherein said coupling means is adapted to permit said angular displacement with respect to said vertical axis.

46. An adjustment apparatus for a ski binding having first and second displaceable jaw elements adapted to be displaceably mounted on said ski and adapted to hold a boot on a ski, said apparatus comprising:

(a) first and second adjustment means for adjusting the displacement of said first and second jaw elements, respectively;

(b) means for connecting said first and second adjustment means to said first and second jaw elements, respectively, such that the longitudinal axes of said first and second adjustment means are pivoted with respect to an element attached to said ski in response to adjusting said displacement of said first and second jaw elements; and (c) coupling means for coupling said first and second adjustment means so that displacement of one of said jaw elements displaces the other of said jaw elements.

47. The apparatus defined by claim 46 wherein said first and second adjustment means are adapted to be pivoted between at least a first and a second position, wherein in said first position the longitudinal axes of said first and second adjustment means are aligned with each other, wherein in said second position said longitudinal axes of said first and second adjustment means form less than a 180 degree angle with each other.

48. The apparatus defined by claim 47 wherein said coupling means comprises means for maintaining the connection between said first and second adjustment means in said first and second positions of said first and second adjustment means.

49. The apparatus defined by claim 48 in combination with said jaw elements, wherein said first and second jaw elements each have one threaded opening therein, wherein said first and second adjustment means each comprises a screw adapted to be threaded in one of said threaded openings in said first and second jaw elements.

50. A safety binding for holding a boot on a ski, comprising:

(a) a jaw, comprising first and second jaw elements pivotally attached to said ski and adapted to hold a boot on said ski, (b) first and second adjustment means for adjusting the angular position of said first and second jaw elements, respectively; and (c) coupling means for coupling said first and second adjustment means wherein adjustment of the angular displacement of one of said jaw element adjusts the angular displacement of the other of said jaw elements.

51. The binding defined by claim 50 wherein said first jaw element comprises a threaded opening therein, wherein said second jaw element comprises a threaded opening therein, wherein said first and second adjustment means comprise first and second threaded screws, wherein said first screw is adapted to the screwed into said opening in said first jaw element and wherein said second screw is adapted to be screwed into said opening in said second jaw element, wherein said coupling means comprises means for coupling the rotation of said screws.

52. The binding defined by claim 51 wherein the length of said openings in said first and second jaw elements is longer than the length of said screws, wherein said screws are oppositely threaded from each other, wherein said openings are oppositely threaded from each other.

* * * * *